US008424860B2

(12) United States Patent
Flück et al.

(10) Patent No.: US 8,424,860 B2
(45) Date of Patent: Apr. 23, 2013

(54) STITCHER FOR VARIABLE THICKNESS PRODUCTS

(75) Inventors: Andreas Flück, Hunzenschwil (CH); Daniel Graber, Bottenwil (CH); Lukas Dysli, Aarau (CH)

(73) Assignee: Müller Martini Holding AG, Hergiswil (CH)

( * ) Notice: Subject to any disclaimer, the term of this patent is extended or adjusted under 35 U.S.C. 154(b) by 0 days.

(21) Appl. No.: 13/029,927

(22) Filed: Feb. 17, 2011

(65) Prior Publication Data

US 2011/0198795 A1 Aug. 18, 2011

(30) Foreign Application Priority Data

Feb. 18, 2010 (CH) ..... 0197/10

(51) Int. Cl.
*B42B 4/00* (2006.01)

(52) U.S. Cl.
USPC ..... 270/52.18; 270/58.09

(58) Field of Classification Search ..... 270/52.18, 270/58.08, 58.09
See application file for complete search history.

(56) References Cited

U.S. PATENT DOCUMENTS

| | | | | |
|---|---|---|---|---|
| 3,899,165 | A | 8/1975 | Abram et al. | |
| 6,142,353 | A * | 11/2000 | Boss et al. | 227/44 |
| 7,032,898 | B2 * | 4/2006 | Silberbauer | 270/52.18 |
| 7,637,489 | B2 * | 12/2009 | Brunner et al. | 270/52.18 |
| 7,775,509 | B2 * | 8/2010 | Langenegger et al. | 270/21.1 |
| 7,780,157 | B2 * | 8/2010 | Brunner et al. | 270/52.18 |
| 2004/0094883 | A1 * | 5/2004 | Silberbauer | 270/52.18 |
| 2006/0043663 | A1 * | 3/2006 | Vogel et al. | 270/37 |
| 2007/0069443 | A1 * | 3/2007 | Brunner et al. | 270/52.18 |
| 2009/0160115 | A1 * | 6/2009 | Iguchi et al. | 270/58.09 |
| 2012/0139177 | A1 * | 6/2012 | Curley et al. | 270/12 |

FOREIGN PATENT DOCUMENTS

| | | | |
|---|---|---|---|
| EP | 0958942 | A | 11/1999 |
| EP | 1419898 | A | 5/2004 |
| EP | 1629992 | A | 3/2006 |
| EP | 1769937 | A | 4/2007 |

* cited by examiner

*Primary Examiner* — Patrick Mackey
(74) *Attorney, Agent, or Firm* — Lucas & Mercanti, LLP; Klaus P. Stoffel

(57) ABSTRACT

A method and device for stitching printed products with a stitching machine, which includes a stitcher head and a bending device, which travel concomitantly with each printed product as it is conveyed in a travel direction during the stitching operation. The bending device is positioned first in a first position, which corresponds to the thickness of the printed products and is a certain distance away from the stitcher head in the direction transverse to the travel direction. Before a printed product is introduced, its thickness is determined and compared with a predetermined limit value; and, if this limit value is exceeded, the bending device is brought into a predetermined second position, which is farther away than the first position from the stitching head. After the printed product has been introduced, the bending device is moved back into the first position, and the wire stitch is driven into the printed product.

18 Claims, 6 Drawing Sheets

STITCHER FOR VARIABLE THICKNESS PRODUCTS

BACKGROUND OF THE INVENTION

The invention pertains to a method for stitching printed products with a stitching machine, which comprises at least one stitcher head traveling concomitantly with a printed product being conveyed in a product travel direction and at least one concomitantly traveling bending device, and to a stitching machine.

Methods for stitching printed products such as brochures, magazines and the like have been known for a long time. EP 1 629 992 A, for example, discloses a method in which individual printed sheets are assembled on the saddle chain of a saddle stitcher and conveyed in the form of a saddle to a stitching machine. The wire stitch used for stitching is formed in the stitcher head of the stitching machine, which comprises a driver and a bender in the usual manner. The wire stitch driven through the printed product is then closed by a bending device. Between the stitcher head and the bending device there is an intermediate space, through which the printed products to be stitched are conveyed and in which they are stitched. To change the machine over to a printed product with a different product thickness, the stitcher head is shifted vertically either by hand or by a motor.

Through EP 0 958 942 A, a wire stitching machine has become known, which can be adapted to printed products of different thicknesses even during the course of a processing order. For this purpose, the bending device is supported from underneath in such a way that it can move downward and out of the way as needed when the thickness of the printed products to be stitched changes. A hand wheel is provided, which operates by way of a cam to adjust a bending support element to the thickness of the thinnest printed product to be processed. When thicker printed products are delivered to the wire stitching machine, the bending support element moves downward under the opposing force of a spring. To adapt the machine to especially thick, bulky printed products, the control cams of the stitching machine must be replaced.

A stitching device with adjusting means arranged above the stitcher head is known from EP 1 769 937 A. To adapt the machine to printed products of different thicknesses arriving successively during the course of processing, the stitcher head is designed so that it can be shifted vertically by these adjusting means.

It is becoming increasingly important to stitch bulky printed products consisting of a relatively large number of printed sheets assembled prior to the stitching operation. Not only the number of assembled printed sheets but also their folds and the air enclosed between the individual printed sheets contribute to the bulkiness of such products. The printed products to be stitched can comprise a thickness of more than 20 mm. It is difficult, however, to stitch such bulky printed products properly. Although a longer stroke is necessary to stitch bulky printed products, the time available for this is not usually any longer than that available for stitching less bulky printed products. So that stitching can be carried out in a functionally reliable and proper manner, bulky printed products must be precompressed before they are introduced into the stitching machine. The printed products are highly deformed by this, however; in particular, they are flattened out. This can cause the formation of marks, tears, and folded-over sheets. Defective printed products of this type must be discarded.

Finally, a device for producing printed products is known from EP 1 419 898 A, by means of which printed products of different thicknesses arriving in succession can be stitched without manual interventions on the adjusting means of the machine. In addition to a thickness-measuring device connected to a control unit, the machine has for this purpose a setting means, designed as a rotational angle-controlled electric motor, which is also connected to the control unit, and by means of which a bending device can be set to handle printed products to be stitched of a certain thickness; in addition, the height of the bending device can also be adjusted appropriately when the thickness of the succeeding printed product is greater than that of the product preceding it. The use of a rotational angle-controlled electric motor does in fact make it possible to shift the bending device and thus to adjust its height in a variable manner, but it also leads to a not inconsiderable increase in the cost of the machine. This is the case in particular when a machine already equipped with manual height adjustment is to be retrofitted with setting means for adjusting the height of the bending device.

SUMMARY OF THE INVENTION

The invention is based on the goal of proposing a low-cost stitching method and a corresponding stitching machine, by means of which even bulky printed products can be stitched easily and properly without reducing output and also in a functionally reliable manner.

The goal is achieved with respect to a method of the general type in question in that, before the printed product is introduced, its thickness is determined; the value thus found is compared with a predetermined limit value; and, if this limit value is exceeded, the bending device is moved out of a first position appropriate to the thickness of the printed products to be stitched into a predetermined second position, which is farther away than the first position, i.e., the position assumed during the stitching operation, from the stitcher head in the direction transverse to the product travel direction. After the printed product has been introduced between the stitcher head and the bending device, the latter is moved transversely to the product travel direction back into its first position again, in which the wire stitch is driven into the printed product. This ability to shift the bending device from its first position into its second position and vice versa makes it possible to stitch even bulky printed products easily and properly without reducing output and also in a functionally reliable manner.

For this purpose, a preliminary check is made each time a printed product is fed into the stitching machine to determine whether the distance between the stitcher head and the bending device is large enough to allow the product to be introduced unhindered. If this is not the case, that is, if a bulky printed product which exceeds a certain predetermined limit value is being introduced, the bending device is shifted away from the stitcher head into the predetermined second position, so that the printed product can be introduced without hindrance. After the printed product has been introduced, the bending device executes a movement toward the stitcher head before and in addition to the movement which it executes to close the wire stitches; that is, it is brought back from its second position into the first position again. In addition, the stitcher head executes a movement which holds and/or compresses the printed product. After the stitching operation, the bending device remains in this first position, whereas the stitcher head travels back away from the bending device, i.e., away from the printed product.

Because of the retracted second position of the bending device, the introduction of the printed product to be stitched is restricted only by the distance between the stitcher head and the saddle chain. The bending device therefore no longer restricts the available space, for which reason there is no longer any need to precompress the printed products before they are introduced into the stitching machine as was required in the past.

Once the unstitched printed product has been fed into the stitching machine, the bending device executes its movement toward the stitcher head, and the stitcher head begins to press the printed product together. As a result, the printed product can be held and simultaneously compressed in a comparatively short time. In the first position of the bending device, the printed product is held in place between this device and the stitcher head, so that the wire stitch can now be pushed in and closed on the side facing the bending device. After the stitching operation has been completed, the stitcher head is moved away from the printed product and the bending device, as a result of which the printed product which has just been stitched is now released and can be conveyed away, leaving the stitching machine ready for the introduction of the next printed product.

In the case of inventive method, therefore, the distance between the bending device and the stitcher head which exists when an unstitched printed product is being introduced can be increased in correspondence with the thickness of the printed product to be stitched, in contrast to the known solutions of the prior art. Therefore, even previously uncompressed, comparatively bulky printed products can be stitched. Because of the large pass-through opening, the individual printed sheets of the as yet unstitched printed product will not collide with the stitcher head as they are being fed into the stitching machine and therefore will not slide across each other or be lifted away from each other and be damaged.

According to an elaboration of the invention, it is provided that the bending device is moved toward the stitcher head and away from the stitcher head in the vertical direction. Such vertical movements can be realized with great functional reliability and with comparatively simple mechanical means.

The stitcher head is preferably arranged above the bending device. In principle, however, a design is also conceivable in which the bending device is arranged above the stitcher head. In the preferred embodiment, the bending device is moved downward from its first position into the second position before the printed product is introduced between the stitcher head and the bending device and then moved back again into the first position after the printed product has been introduced. After the printed product has been stitched and the wire stitch has been closed, the bending device remains in its first position until another bulky product is delivered and detected.

According to an elaboration of the invention in which the printed product is conveyed on a saddle chain of a saddle stitcher to the stitching machine, it is provided that the bending device is moved only so far into its second position transversely to the product travel direction that the upper edge of the bending device projects essentially not at all above the saddle chain. The vertical distance available for the transport of the unstitched printed product is then determined only by the distance between the saddle chain and the stitcher head. This means that it is possible to stitch even bulky printed products properly without the danger of loss of quality.

The stroke of the bending device as it moves transversely to the product travel direction from the first into the second position is preferably at least 5 mm, more preferably 5-10 mm, and especially about 8 mm. According to this method, it is preferable to stitch printed products which comprise a thickness of greater than about 10 mm. Of course, printed products of lesser thickness can also be stitched according to the inventive method. In the case of printed products with a thickness below the predetermined limit value, however, the bending device is not moved from the first into the second position.

The vertical movement of the bending device into its second position can also be used, of course, to adapt the stitching machine to a new processing order with a printed product with a thickness different from that of the current one. The stitching machine does not have to be set in this way for each stitching operation but rather only once, before the stitching of the first printed product of a series of printed products of the same thickness.

The inventive stitching machine is characterized in that a thickness-measuring device in working connection with the machine control unit is arranged upstream of the bending device with respect to the product travel direction, wherein, when the thickness of the printed product to be stitched, as determined by the thickness-measuring device, exceeds a predetermined limit value, the bending device can, before the printed product is introduced between the stitcher head and the bending device, be brought by a drive connected to it into a second predetermined position, which, in the direction transverse to the product travel direction, is farther away than the first position from the stitcher head; and wherein the bending device, after the printed product has been introduced, can be moved by the drive transversely to the product travel direction back into the first position again, in which the wire stitch is driven into the printed product.

In an advantageous embodiment of the invention, the drive is formed by the main drive of the stitching machine or by a separate drive, especially a servo drive. The drive is advantageously adjustable to a predetermined pressing force for the bending device.

In an elaboration of the invention, it is provided that the bending device is arranged on a stitching slide, which comprises in particular a stitching slide bottom part and a stitching slide upper part. The stitching slide and thus also the bending device can be moved vertically by means of at least one cylinder, wedge bar, or control cam connected to the drive. This makes it possible to move the bending device connected to the stitching slide in a simple and reliable manner and is especially easy to realize by designing the drive as a separate drive unit, which is mounted on a spindle and is connected to the vertically movable wedge bar supporting the stitcher slide by way of spindle nuts, which are free to move on the spindle. When the wedge bar moves, the stitcher slide and thus the bending device are moved accordingly, either vertically upward or vertically downward.

Additional advantageous features can be derived from the following description, and from the drawing.

BRIEF DESCRIPTION OF THE DRAWING

Exemplary embodiments of the invention are explained in greater detail below on the basis of the drawing.

DETAILED DESCRIPTION OF THE INVENTION

Figure 2:
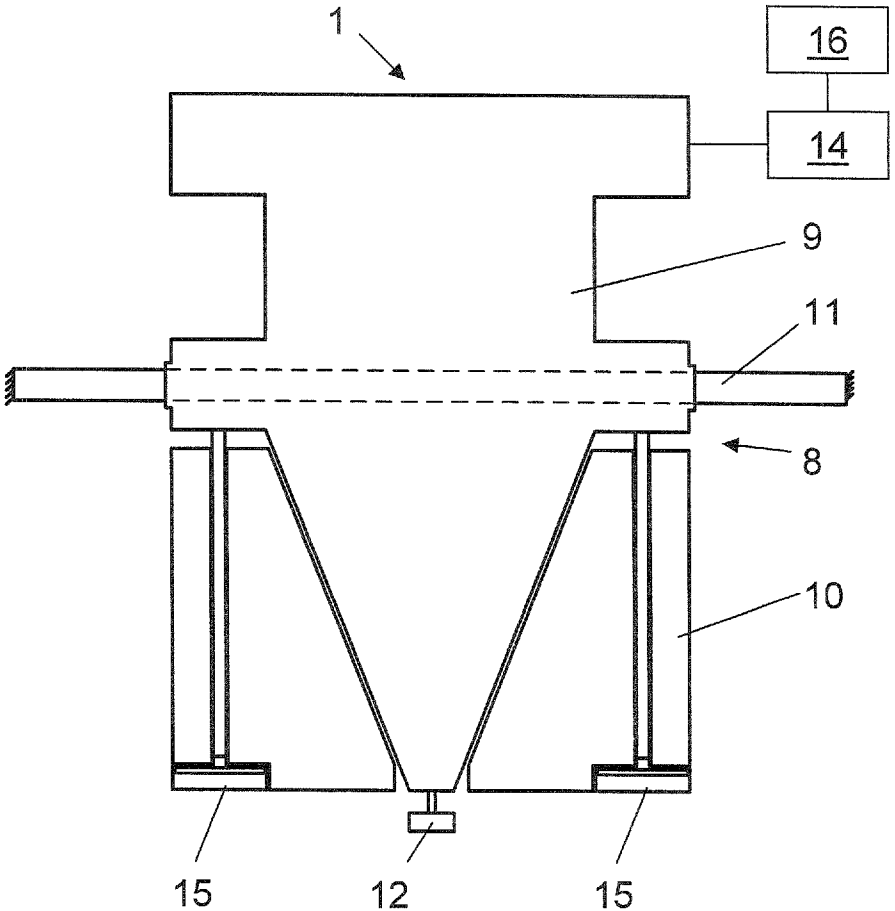
FIG. 2 shows another view of the stitching machine according to FIG. 1.
Figure 1:
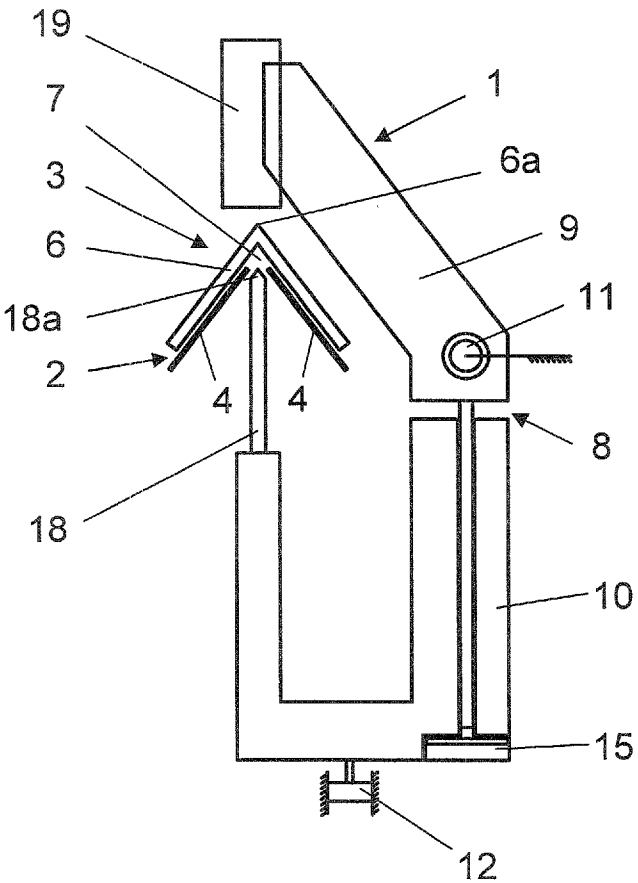
FIG. 1 shows a schematic view of an inventive stitching machine.
Figure 7:
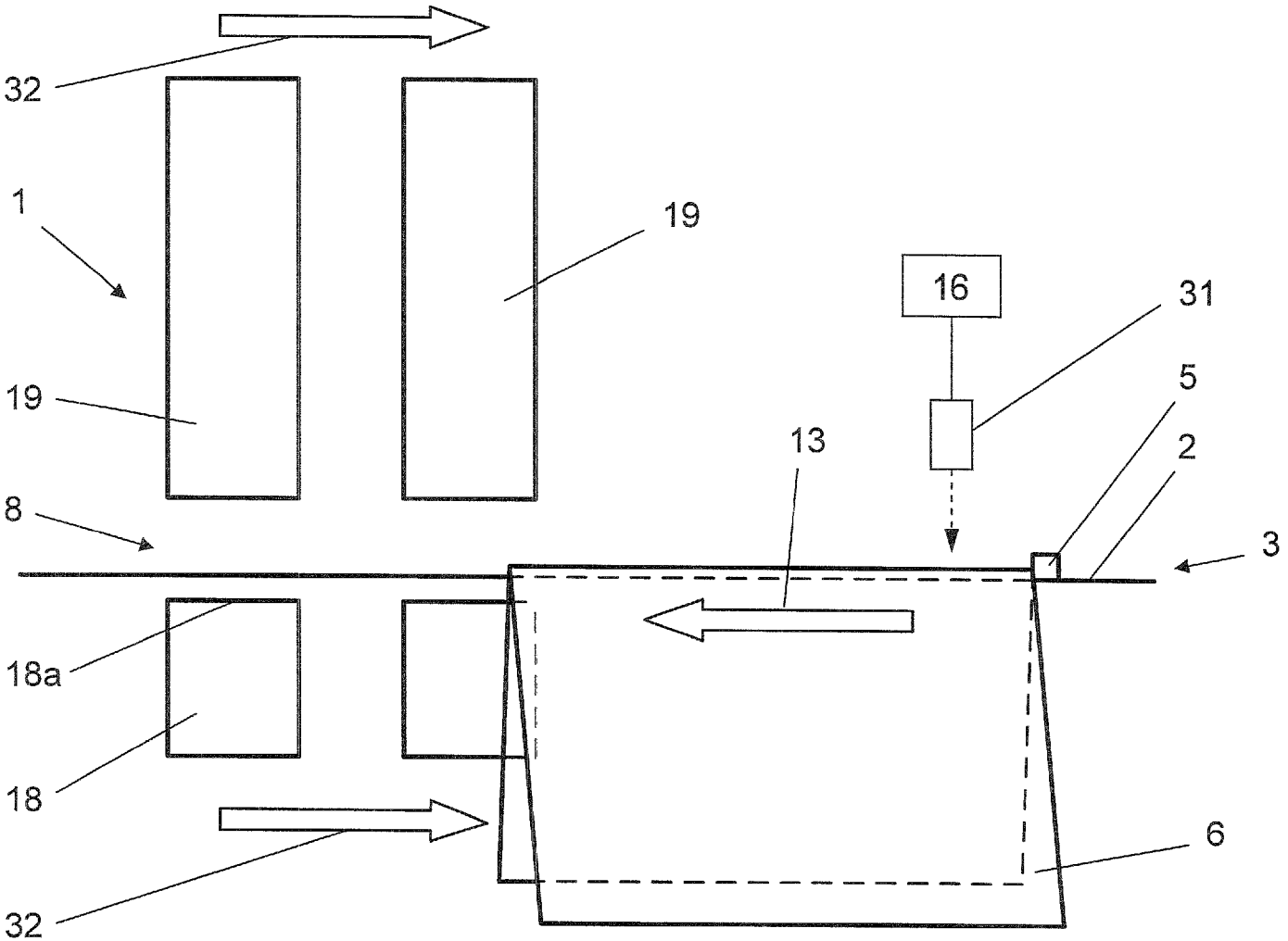
FIG. 7 shows a schematic diagram of the introduction of a printed product into a stitching machine with two stitcher heads and two bending devices.
Figure 8:
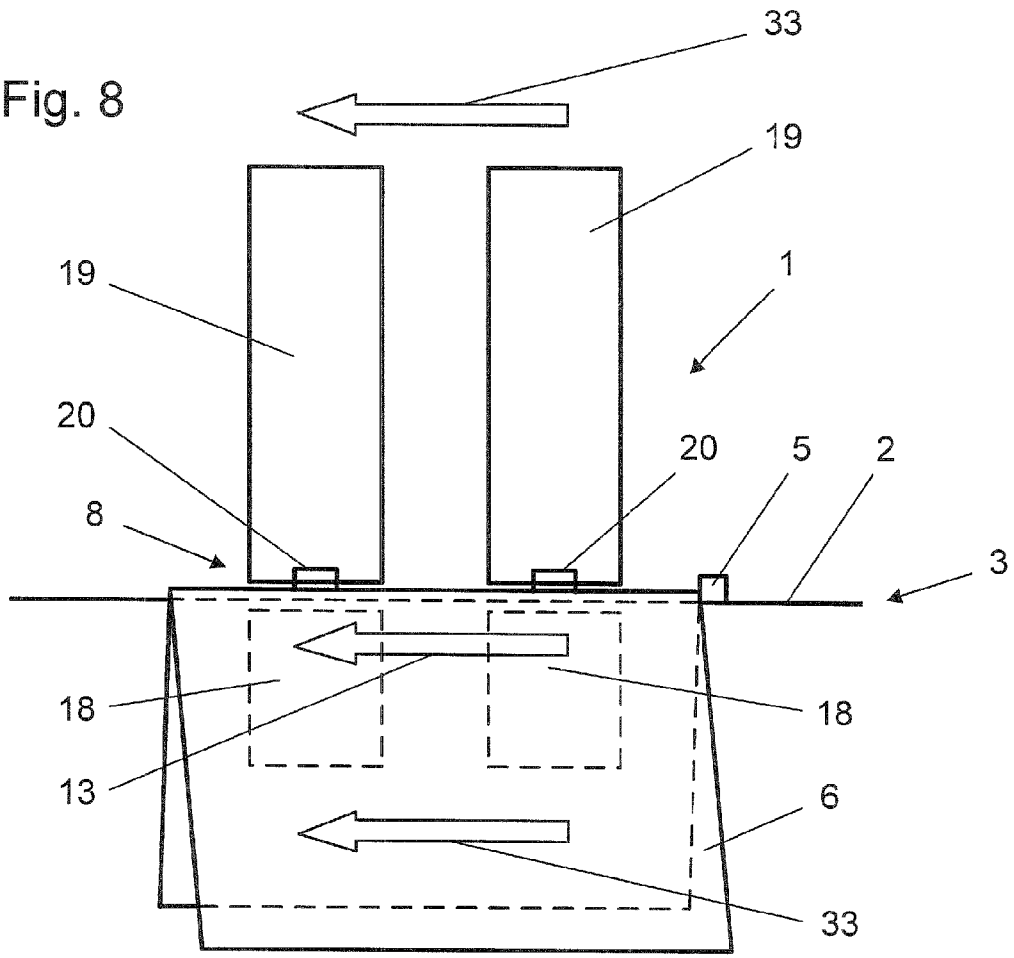
FIG. 8 shows a schematic diagram of the stitching of the printed product which has been introduced into the stitching machine according to FIG. 7.

FIGS. 1 and 2 show a stitching machine 1, which is arranged on a saddle chain 2 of a saddle stitcher 3 known in and of itself. The saddle chain 2 has guide plates 4, which are designed in the form of saddles and on which the printed products 6 can be transported by pusher dogs 5 (FIGS. 7 and 8). Each of the printed products has a fold 6*a*. The guide plates 4 are designed so that a gap 7 is present between them, which extends in the longitudinal direction of the saddle chain 2. The printed products 6 to be stitched consist of individual printed sheets (not shown here) which have been assembled upstream of the stitching machine 1 on passage through an assembly section (not shown) of the saddle chain 2. In the area of the assembly section, the thickness of the printed product 6 at its fold 6*a* can be considerably greater than 10 mm, for example. After the stitching operation, during the course of which the printed product 6 is compressed, especially in the area of its fold 6*a*, the thickness of the printed product 6 at its fold 6*a* is reduced to, for example, only 9.5 mm, and the total thickness of the printed product 6 is therefore 19 mm.

The stitching machine 1 has a stitching slide 8 with a stitching slide upper part 9 and a stitching slide lower part 10. So that the stitching slide 8 can travel along with each one of the printed products 6 being conveyed on the saddle chain 2, it is supported on an upper guide 11 and a lower guide 12, along which it is free to move. The upper guide 11 is designed here, for example, as a stationary guide rod, on which the upper part 9 of the stitching slide is supported. The sliding movement is accomplished here in the known manner by means of a drive 14. The lower part 10 of the stitching slide is supported on the upper part 9 in such a way that the latter can move transversely to a product travel direction 13 (FIGS. 7 and 8), that is, vertically downward and vertically upward. For this purpose, two cylinders 15 are provided, which are operated by the drive 14 of the stitching machine 1, forming the main drive, and which are connected at the top end to the upper part 9 of the stitching slide and at the bottom end to the lower part 10 of the stitching slide. The cylinders 15 are designed as pneumatic actuating cylinders, for example, and are controlled by a machine control unit 16. The vertical movements of the lower part 10 of the stitching slide are limited by stops (not shown here). These stops can be adjustable. The corresponding stroke is therefore preferably adjustable. The lower guide 12 is designed so that it allows the previously mentioned vertical movements. As an alternative to the use of the drive 14, forming the main drive, to shift the stitching slide vertically, it is also possible to use a separate drive 17 (FIG. 4), such as a servo motor, which is in working connection with the machine control unit 16, and which is advantageously settable to a predetermined pressing force.

At least one bending device 18, designed as a bending block, is connected to the lower part 10 of the stitching slide. This bending device moves jointly with the lower part 10. Above the bending device 18, a stitcher head 19 is arranged, which is attached to the upper part 9 of the stitching slide and moves along with it. In a manner known in and of itself, a wire stitch 20 (FIG. 8) is formed from wire and driven from above through the printed product 6 in the area of the fold 6*a* by the stitcher head 19 and then closed on the underside of the product by active or passive bending elements (not shown) of the bending device 18. The bending device 18 has an upper end 18*a*, which is located preferably somewhat below the gap 7 between the guide plates 4, but it can also project into the area of the gap 7. As an alternative to the arrangement described above, the stitcher head 19 and the bending device 18 can also be offset from each other differently in the direction transverse to the product travel direction 13. Thus the stitcher head 19 can, for example, be arranged underneath the bending device 18.

Figure 4:
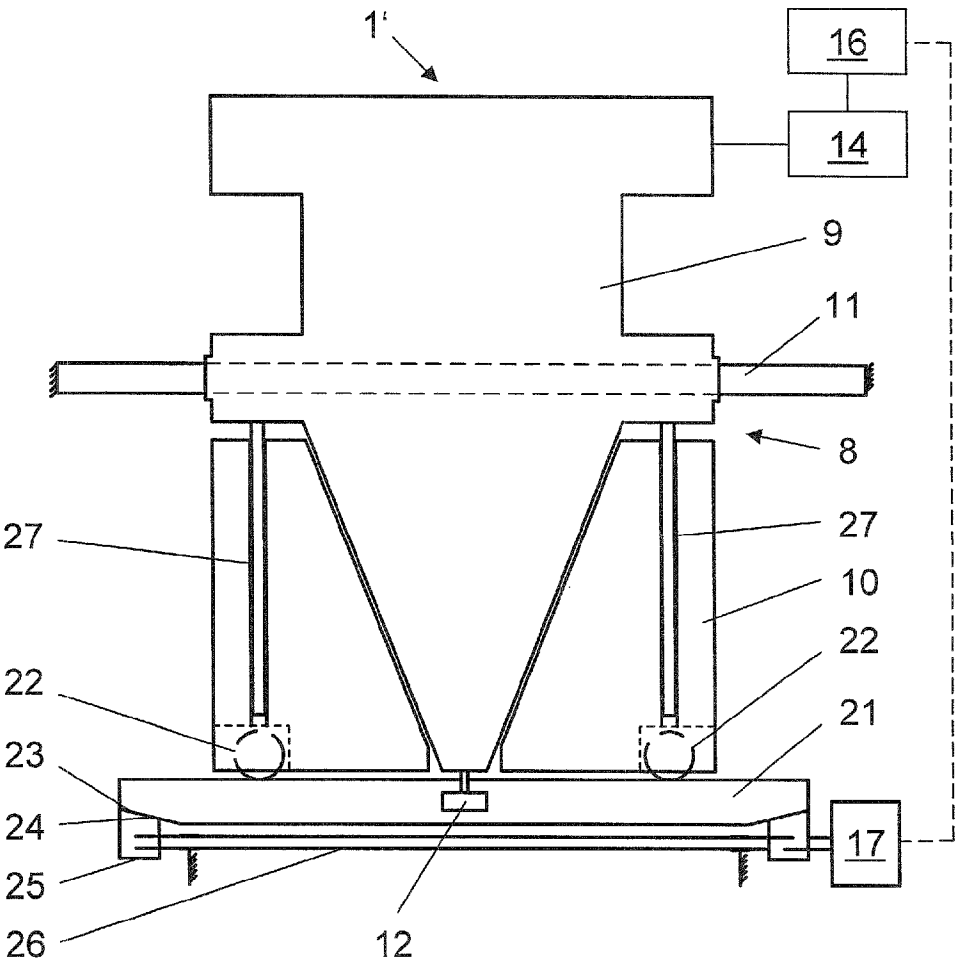
FIG. 4 shows another view of the stitching machine according to FIG. 3.
Figure 3:
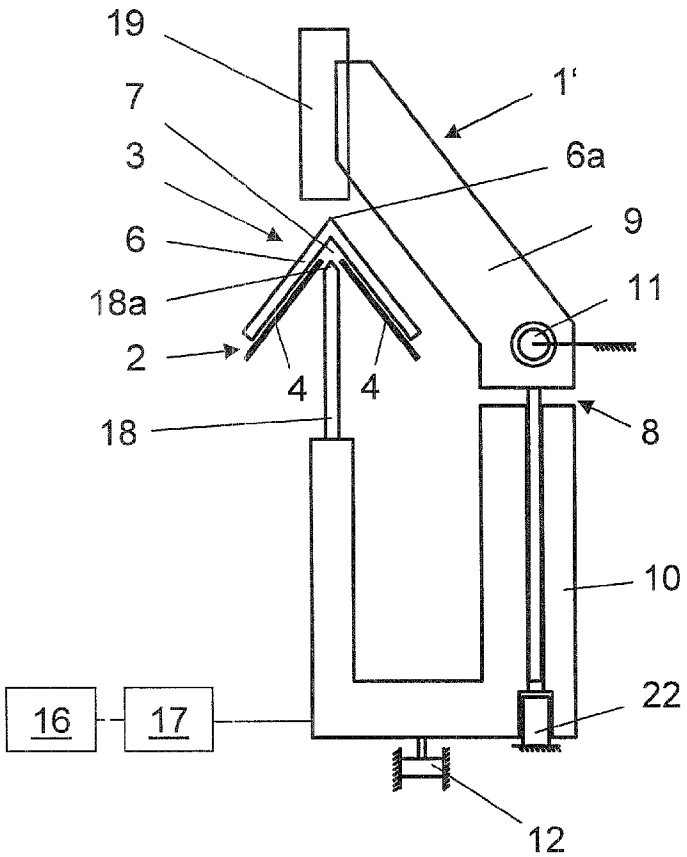
FIG. 3 shows a schematic view of a variant of the stitching machine.
Figure 5:
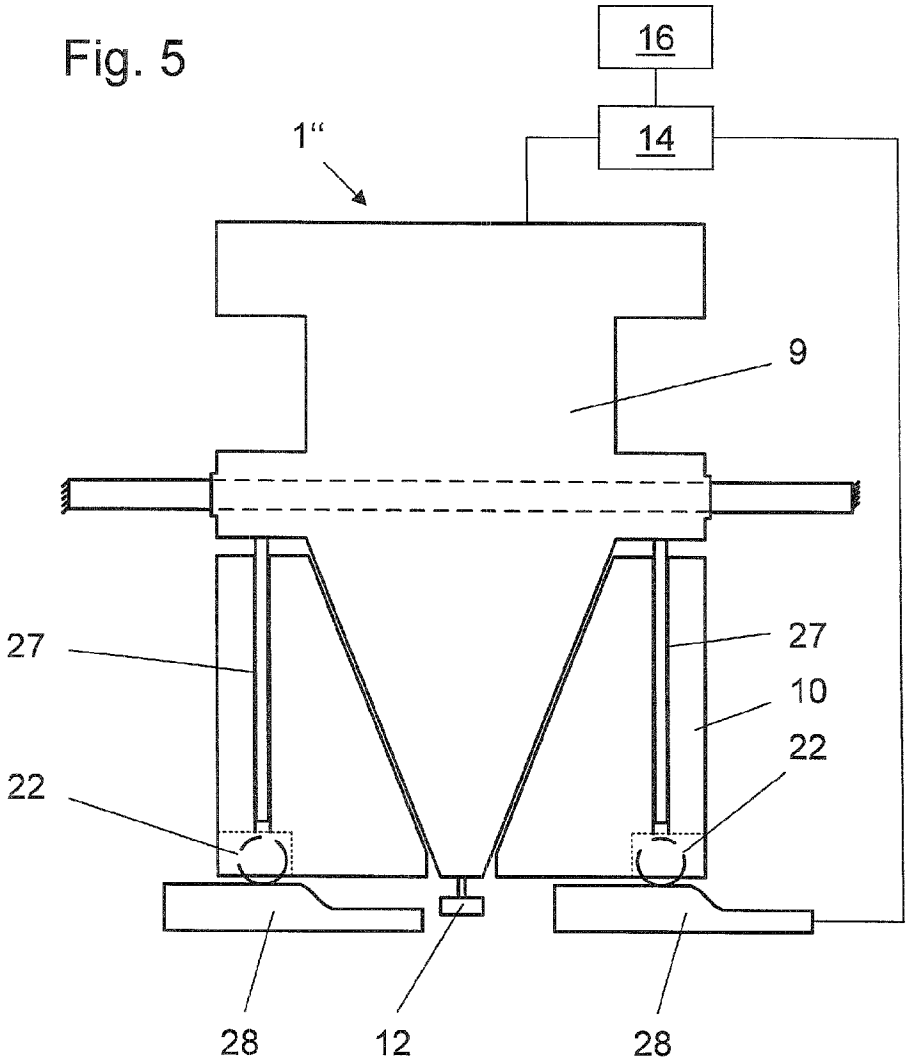
FIG. 5 shows a diagram, similar to that of FIGS. 2 and 4, of another exemplary embodiment of a stitching machine.

FIGS. 3 and 4 show a stitching machine 1', which differs from the stitching machine 1 described above in that the vertical movements of the lower part 10 of the stitching slide, i.e., of the bending device 18 connected to it, are brought about by a wedge bar 21, on which the lower part 10 of the stitching slide rests by two rollers 22 spaced a certain distance apart. Each end of the wedge bar 21 has a control cam 23, which rests on a correspondingly designed wedge surface 24 of a spindle nut 25, which can be shifted horizontally by a spindle 26. The spindle 26 is operated by the separate drive 17, designed, for example, as a servo motor, which is advantageously mounted directly on the spindle 26. When the distance between the two spindle nuts 25 is decreased by the rotation of the spindle 26, the wedge bar 21 travels upward. Correspondingly, the stitching slide lower part 10 moves upward together with the bending device 18. When the distance between the spindle nuts 25 is increased, the stitching slide lower part 10 accordingly moves downward. During these movements, the lower part 10 of the stitching slide is guided on rods 27, which are attached to the upper part 9 of the stitching slide. In the direction of the saddle chain 2, that is, opposite the product travel direction 13, the stitching slide 8 is guided by the lower guide 12, which can be designed in a manner similar to that used for the stitching machine 1. To the person skilled in the art, it will be obvious that there are other possible ways of moving the lower part 10 of the stitching slide of a stitching machine 1" in the vertical direction, such as by means of one or more control cams 28 (FIG. 5).

As previously mentioned, there is no reason in principle why the bending device 18 could not be attached to the upper part 9 of the stitching slide. In this case (not shown), the stitcher head 19 would be mounted on the lower part 10 of the stitching slide, and the cylinders 15, the wedge bar 21, or the control cam 28 would be arranged on the upper part 9 of the stitching slide.

The previously mentioned vertical movements of the lower part 10 of the stitching slide are movements which are executed in addition to, and in synchrony with, the associated stitching operation, that is, with the formation, driving-in, and closing of a wire stitch 20. This is explained in greater detail below on the basis of FIGS. 6*a*-6*c*, 7, and 8.

Figure 6A:
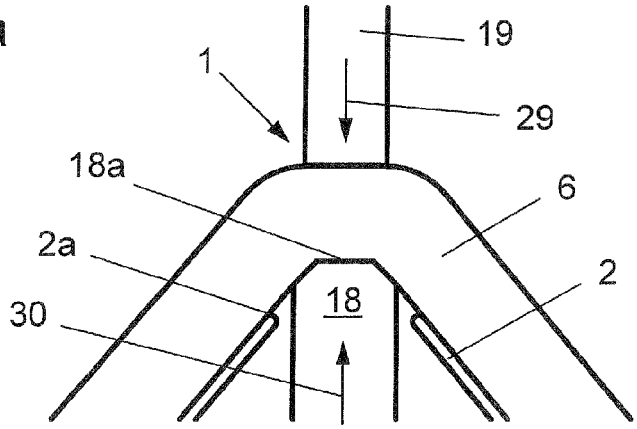
FIG. 6*a* shows a schematic cross section of a stitching machine in illustration of the movements of the stitcher head and the bending device.

FIG. 6*a* shows a schematic diagram of the stitching machine 1 with a bulky printed product 6, which has been introduced by the saddle chain 2 and onto which the stitcher head 19 has been lowered in a vertical direction 29 transversely to the product travel direction 13. The bending device 18 has also been brought up from underneath in the vertical direction 30, thus compressing the printed product 6. The bending device 18 is thus positioned in correspondence with the thickness of the printed products 6 to be stitched, that is, with the thickness of the already precompressed printed products. In this first position of the bending device 18, the top end 18*a* of the device projects beyond an upper edge 2*a* of the saddle chain 2. It is also in this first position of the bending device 18, with the stitcher head 19 in the lowered position, that the printed product 6 will be stitched at a later point.

Figure 6B:
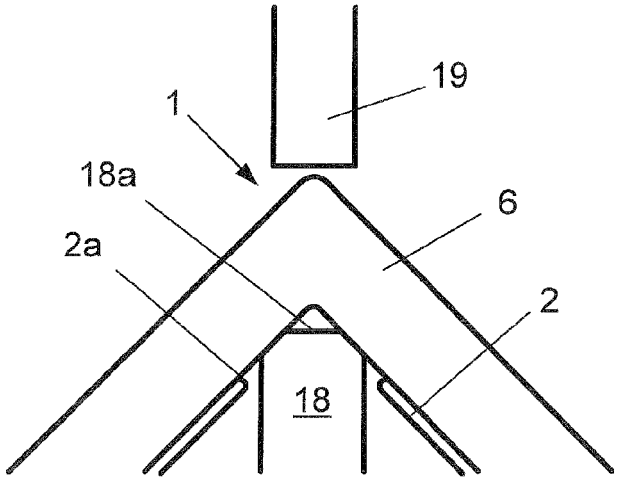
FIG. 6*b* shows a schematic diagram of the first position of the bending device during the introduction of a printed product.

FIG. 6*b* shows the introduction of a thick, that is, bulky, printed product 6 into the stitching machine 1. The stitcher head 19 is located in an upper position, and the bending device 18 is in its first position, which has already been preset in correspondence with the thickness of the printed products 6 to be stitched, the top end 18*a* projecting beyond the upper edge 2*a* of the saddle chain 2. It can easily be seen that, when a bulky printed product 6 is being introduced, the relatively short distance between the printed product 6 and the stitcher head 19 present in this first position of the bending device 18 creates the danger that individual printed sheets of the printed product 6, which at this point have not yet been stitched together or even compressed, can collide with the stitcher head as they are being fed into the stitching machine 1 and thus slide across each other or even be lifted away from each other and damaged.

Figure 6C:
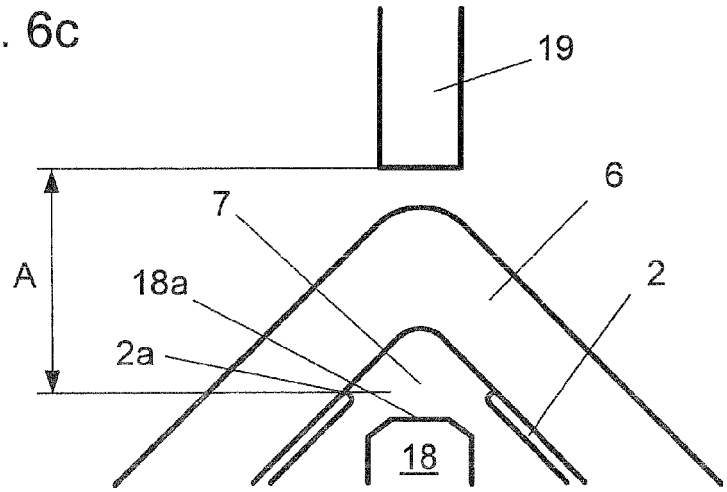
FIG. 6*c* shows a schematic diagram of the second position of the bending device during the introduction of a printed product.

To eliminate this danger, the thickness of the printed product 6 to be stitched is determined before it is introduced; the value thus found is compared with a predetermined limit value; and, if this limit value is exceeded, the bending device 18 is brought into a predetermined second position, this second position being farther away than the first position from the stitcher head 19 in the direction transverse to the product travel direction 13, as shown in FIG. 6*c*. As can be seen, the top end 18*a* of the bending device 18 does not project here beyond the upper edge 2*a* of the saddle chain 2. As a result, the bending device 18 does not interfere with the gap A between the saddle chain 2 and the stitcher head 19, this being the gap which is available for the introduction of the printed product 6 to be stitched; that is, the space available for the introduction of the printed product 6 to be stitched is greater than that of the known solutions of the prior art. The limit value to be applied is predetermined by the machine operator in correspondence with the current processing order; it can depend, for example, on the safety distance between the printed products and the stitcher head required in the individual case and on the production speed.

To determine the thickness of the printed product 6 to be introduced into the stitching machine 1, a thickness-measuring device 31, designed as a sensor aimed at the saddle chain 2, is arranged upstream, in the product travel direction 13, of the stitcher head 19 and of the bending device 18 (FIG. 7). Of course, the thickness of the printed product 6 can also be determined by some other means, such as by counting in advance the number of printed sheets forming the printed product 6 and by multiplying the known thickness of a printed sheet by this number. A thickness-measuring device 31 can also be arranged downstream, in the product travel direction 13, from the stitcher head 19 and the bending device 18, wherein the determined thickness can be used in this case only to set the bending device 18 for the printed products 6 following along afterwards.

FIG. 6*a* shows the first position of the bending device 18, in which the stitching of the printed product 6 also takes place. In contrast to the in-advance setting of the bending device 18 just described above, the bending device 18 here is already in its first, preset position for the stitching of the printed product 6 or has been brought into the first position in the vertical direction 30 from the second, lowered position. Only after that is the stitcher head 19 lowered in the vertical direction 29, resulting in the fixation and compression of the printed product 6 in the area of its fold 6*a*. After that, the stitcher head 19 drives the wire stitch 20 into the printed product 6.

FIG. 7 shows the product travel direction 13, in which the printed product 6 is conveyed into a stitching machine 1 equipped with two stitcher heads 19 and two bending devices 18. The stitching slide 8 carrying the stitcher heads 19 and the bending devices 18 is simultaneously moved in a first horizontal direction 32 toward the right, opposite the product travel direction 13. As can be seen, the stitcher heads 19 are located in their upper position, and the two bending devices 18 are in their second, lowered position. The space available for the introduction of a printed product 6 between the saddle chain 2 and the stitcher heads 19 is thus larger than that according to the previous solutions of the prior art. If, on the basis of the thickness of the introduced printed product 6 determined by the thickness-measuring device 31, the machine control unit 16 finds that the predetermined limit value is not exceeded, the bending devices 18 are not lowered into their second position; that is, they remain in their first, elevated position.

FIG. 8 shows a printed product 6 after it has been introduced into the stitching machine 1. The two bending devices 18 are located in their first, elevated position, in which the printed product 6 is being securely held. The two stitcher heads 19, which are in their lowered position, work together with the two bending devices 18. The stitching slide 8, equipped with the stitcher heads 19 and the bending devices 18, is moved in a second horizontal direction 33, corresponding to the product travel direction 13, at the same speed as the printed product 6. The printed product 6 can thus be stitched by the concomitantly traveling stitching slide 8. Because the stitching device of this exemplary embodiment comprises two bending devices 18 and two stitcher heads 19, stitching can be conducted with two wire stitches 20 simultaneously. It is obvious that it is also possible to use stitching machines 1 with only one bending device 18 and one stitcher head 19 or a machine with more than two bending devices 18 and stitcher heads 19.

Once the printed product 6 has been stitched, the bending devices 18 remain at least initially in their first position, and the stitcher heads 19 are moved upward into the position shown in FIG. 7, as a result of which the stitched printed product 6 is released again and conveyed away by the saddle chain 2. Essentially at the same time, the stitching slide 8 travels toward the right in its first horizontal direction 32 according to FIG. 7 so that it can accept the following printed product 6 from the saddle chain 2. Thus a new stitching operation can begin. The stroke which the bending devices 18 execute during the movements cited above can differ for each type of printed product 6. This stroke is, for example, approximately 8 mm. The stroke is preferably in the range of 5-10 mm. In addition to the cited vertical movements of the bending device 18, it is also possible to use the cylinders 15, the wedge bar 21, or the control cam 28 to adapt the bending device 18 to printed products 6 of different thicknesses. The cyclical vertical movements of the bending device 18 before and after stitching will then be correspondingly larger or smaller.

The invention claimed is:

1. A method for stitching printed products with a stitching machine having at least one stitcher head, which travels concomitantly with a printed product conveyed in a product travel direction, and at least one concomitantly traveling bending device, the method comprising the steps of:

positioning the bending device in a first position, which corresponds to a thickness of the printed product to be stitched and which is a certain distance away from the stitcher head in a direction transverse to the product travel direction;

conveying the printed product to the stitching machine on a saddle chain of a saddle stitcher, the bending device when in the first position extending above an upper edge of the saddle chain and holding the printed product;

determining a thickness value of the printed product to be stitched;

comparing the thickness value with a predetermined limit value;

moving, if the limit value is exceeded, the bending device into a predetermined second position, which is farther away from the stitcher head than the first position in the direction transverse to the product travel direction, in which second position the bending device is below the upper edge of the saddle chain;

introducing the printed product in the product travel direction between the stitcher head and the bending device;

moving the bending device back into the first position in the direction transverse to the product travel direction so that the bending device again holds the printed product;

securely holding the introduced printed product by moving the stitcher head toward the bending device in the direction transverse to the product travel direction;

driving a wire stitch into the securely held printed product by way of the stitcher head;

closing the driven-in wire stitch by a closing movement of the bending device; and releasing the stitched printed product after closing of the wire stitch.

2. The method according to claim 1, wherein the movement of the bending device toward the stitcher head and the movement away from the stitcher head proceed vertically.

3. The method according to claim 1, wherein the stitcher head is arranged above the bending device, and, before the printed product is introduced between the stitcher head and the bending device, the bending device is moved downward from the first position into the second position and is moved back up into the first position again after the printed product has been introduced.

4. The method according to claim 3, including conveying the printed product to the stitching machine on a saddle chain of a saddle stitcher, and moving the bending device transversely to the product travel direction into the second position to an extent that an upper edge of the bending device essentially does not project above the saddle chain.

5. The method according to claim 1, wherein a stroke of the bending device as the bending device moves transversely to the product travel direction from the first into the second position is at least 5 mm.

6. The method according to claim 5, wherein the stroke is 5-10 mm.

7. The method according to claim 6, wherein the stroke is approximately 8 mm.

8. The method according to claim 1, wherein printed products with a thickness of more than 10 mm are stitched.

9. A stitching machine for stitching printed products, comprising:

a machine control unit;

at least one stitcher head traveling concomitantly with a conveyed printed product in a product travel direction;

a saddle chain for conveying the printed product;

at least one concomitantly traveling bending device;

a drive for moving the bending device into a first position, which corresponds to a thickness of the printed product to be stitched and which is a certain distance away from the stitcher head in a direction transverse to the product travel direction so that the bending device extends above an upper edge of the saddle chain and holds the printed product, the drive being in controlled communication with the machine control unit; and a thickness-measuring device in working connection with the machine control unit, wherein the control unit is operative so that if the thickness of the printed product to be stitched as determined by the thickness-measuring device exceeds a predetermined limit value the drive moves the bending device into a second, predetermined position, which is farther away from the stitcher head than the first position in the direction transverse to the product travel direction and in which the bending device is below the upper edge of the saddle chain, before the printed product is introduced between the stitcher head and the bending device, the control unit being further operative so that, after the printed product has been introduced, the drive moves the bending device transversely to the product travel direction back into the first position so that the bending device again holds the printed product.

10. The stitching machine according to claim 9, wherein the drive is formed by a main drive of the stitching machine or by a separate drive.

11. The stitching machine according to claim 10, wherein the separate drive is a servo drive.

12. The stitching machine according to claim 9, wherein the drive is settable to a predetermined pressing force.

13. The stitching machine according to claim 9, further comprising a stitching slide, the bending device being mounted on the stitching slide, and further comprising at least one cylinder, at least one wedge bar, or at least one control cam connected to the drive so as to move the bending device vertically.

14. The stitching machine according to claim 13, wherein the stitching slide includes a stitching slide lower part and a stitching slide upper part.

15. The stitching machine according to claim 13, wherein the drive is a separate drive mounted on a spindle, spindle nuts being freely movably mounted on the spindle and the vertically movable wedge bar resting on the spindle nuts and carrying the stitching slide.

16. The stitching machine according to claim 9, wherein the thickness-measuring device is arranged upstream, in the product travel direction, of the bending device.

17. The stitching machine according to claim 9, comprising two bending devices and two stitcher heads, and further comprising a stitching slide, the two bending devices being arranged on the stitching slide so as to be movable jointly from the first position into the second position in a direction transverse to the product travel direction.

18. The stitching machine according to claim 9, wherein the bending device is adaptable to different thicknesses of the printed products to be stitched.

* * * * *